US005263201A

United States Patent [19]

Hood

[11] Patent Number: 5,263,201

[45] Date of Patent: Nov. 23, 1993

[54] TROUSERS HAVING ZIPPER SLIDE WITH BUTTON

[76] Inventor: Stephen G. Hood, 8110 Raintree La., Charlotte, N.C. 28226

[21] Appl. No.: 984,922

[22] Filed: Dec. 2, 1992

[51] Int. Cl.[5] ..... A41D 1/06

[52] U.S. Cl. ..... 2/234; 2/235; 24/387

[58] Field of Search ..... 2/219, 234, 235, 96, 2/128, 234, 227; 24/387, 390, 415, 418, 419, 429, 431, 436, 101 R, 342

[56] References Cited

U.S. PATENT DOCUMENTS

| | | | |
|---|---|---|---|
| 1,348,392 | 8/1920 | Cook | 2/218 |
| 1,447,627 | 3/1923 | Primoshic | 24/431 |
| 1,651,544 | 12/1927 | Prentice | 24/429 |
| 1,658,392 | 2/1928 | Prentice et al. | 24/431 |
| 1,734,422 | 11/1929 | Feit | 2/234 |
| 2,111,924 | 3/1938 | Etten | 2/234 |
| 2,148,757 | 2/1939 | Kilkenny | 24/431 |
| 2,221,759 | 11/1940 | Erard | 24/431 |
| 2,223,347 | 12/1940 | Axthelm | 24/205 |
| 2,343,349 | 3/1944 | Wahl | 24/431 |
| 2,579,276 | 12/1951 | Schworm, Jr. | 2/69.5 |
| 2,656,579 | 10/1953 | Wilson | 24/205.11 |
| 2,675,559 | 4/1954 | Miller | 2/234 |
| 2,688,138 | 9/1954 | Glass | 2/234 |
| 3,255,503 | 6/1966 | Sozzi | 2/234 |
| 3,271,832 | 9/1966 | Yankers | 24/205.11 |
| 3,276,086 | 10/1966 | Reese | 24/205.11 |
| 3,448,463 | 6/1969 | Milone | 2/234 |
| 4,575,873 | 3/1986 | Smith | 2/234 |
| 4,928,363 | 5/1990 | Easton | 24/390 |
| 5,008,985 | 4/1991 | Thompson | 24/370 |

FOREIGN PATENT DOCUMENTS

| | | | |
|---|---|---|---|
| 522593 | 11/1955 | Belgium | 24/429 |
| 638646 | 11/1936 | Fed. Rep. of Germany | 24/418 |
| 1016063 | 10/1952 | France | 24/431 |
| 184275 | 8/1936 | Switzerland | 24/418 |
| 389024 | 3/1933 | United Kingdom | 2/128 |

*Primary Examiner*—Clifford D. Crowder
*Assistant Examiner*—Amy B. Vanatta
*Attorney, Agent, or Firm*—Bell, Seltzer, Park & Gibson

[57] ABSTRACT

The present invention relates to a zipper that closes the opening between overlapping fabric portions for a pair of trousers. The zipper slide component of the zipper includes a button and the waistband of the trousers has a button hole in the outer overlapping fabric portion to receive a button that is secured to the zipper slide. The zipper preferably has its upper end extending into the waistband of the trousers and terminating about midway of the width of the waistband to allow the button on the slide to cooperate with the button hole when the zipper is in the closed position.

6 Claims, 2 Drawing Sheets

TROUSERS HAVING ZIPPER SLIDE WITH BUTTON

FIELD OF THE INVENTION

The present invention relates generally to garments, such as trousers and, more particularly, to a zipper that closes the opening between overlapping fabric portions for a pair of trousers.

BACKGROUND OF THE INVENTION

Slide fasteners, such as zippers, have long been used for securing together a pair of overlapping fabric portions defining an access opening for and facilitating the placing on and removal of a garment. The zipper is typically attached to the overlapping fabric portions, however, as is typical for trousers, the overlapping fabric portions are also further secured together at the waistband adjacent the upper end of the zipper. A button, hook, or snap is typically provided in the waistband area. This additional closure permits the wearer to first draw together and secure the fabric portions, and then more easily move the zipper to the closed position.

It is not unheard of that a wearer will secure the button, hook or snap, yet forget to close the zipper. At other times, the zipper may accidentally slide open if it is improperly closed or during movement of the wearer. Obviously, an unintentional opening may cause considerable embarrassment to the wearer.

Attempts have been made to address the problem of a zipper accidentally coming open. For example, U.S. Pat. Nos. 3,271,832, 2675,559, and 2,656,579 disclose attachments to conventional zipper slides that, when the zipper slide is in the up and closed position, retain the zipper slide in the closed position. U.S. Pat. No. 3,271,832 discloses a hook on the zipper slide that is secured to a receiving loop for a conventional hook waistband closure. Similarly, U.S. Pat. 2,675,559 discloses a ring carried by the slide to secure the slide to a portion of a conventional snap in the waistband of a pair of trousers. U.S. Pat. No. 2,656,579 discloses a relatively bulky hook-like member that extends up and over the edge of the waistband of the trousers to maintain the slide in the closed position. In each of the above noted examples, the overlapping fabric portions at the waistband are subsequently secured together by a conventional button, snap or hook and loop after the zipper slide is up. Thus, the wearer may still accidentally forget to close the zipper. Moreover, it is also desirable that any modification to a conventional zipper be relatively compact and simple to operate.

SUMMARY OF THE INVENTION

In view of the foregoing background, it is therefore an object of the present invention to provide a pair of trousers including a zipper that will not accidentally come open.

It is another object of the present invention to provide a pair of trousers including a zipper that requires that the wearer close the zipper to secure the overlapping fabric portions together.

It is still another object of the present invention to provide a relatively simple, compact, and easy to operate zipper for trousers.

These and other objects, features and advantages of the present invention are provided by a zipper attached to the overlapping fabric portions of a pair of trousers, wherein the zipper slide includes a button and the waistband of the trousers has a button hole to receive the button and thus secure the overlapping fabric portions together. The button secured to the slide may also be readily grasped by the wearer to permit the wearer to move the zipper slide to the desired opened or closed position. The button also preferably has a reduced shank portion for further facilitating manipulating and positioning of the button into cooperating relationship with the buttonhole.

The zipper also preferably has an upper end extending into the waistband of the trousers with the teeth of the zipper being exposed and terminating about midway of a width of the waistband. The buttonhole is preferably provided in the waistband of the outermost overlapping fabric portion adjacent an end. The buttonhole receives the button and secures the zipper when in the closed position to prevent accidental opening of the zipper.

The zipper preferably has a pair of opposing fabric tapes and the opposing cooperating teeth are connected to and carried by proximal edges of the pair of tapes. In addition, the waistband preferably has a slit portion in the innermost overlapping fabric portion and through and from which a tape extends to position the teeth carried by the upper end of the tape in exposed accessible position for cooperation with the zipper slide.

The present invention overcomes the drawbacks of previous zipper locking approaches that included a conventional button, hook, snap or loop for securing the upper fabric portions at the waistband of a pair of trousers, as well as a separate hook or device for locking the zipper in the closed position. The present invention combines the zipper locking feature with closure of the upper fabric ends. Accordingly, the wearer cannot place the trousers in a wearable condition without fully closing the zipper and passing the button through the buttonhole in the waistband. The zipper is also securely locked when in the closed position. Additionally, the present invention is easy to manipulate and forms a compact arrangement for securing the overlapping fabric portions together.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, applicant provides this embodiment so that this disclosure will be thorough and complete, and will fully convey the scope of the invention to those skilled in the art. Like numbers refer to like elements throughout.

Figure 1:
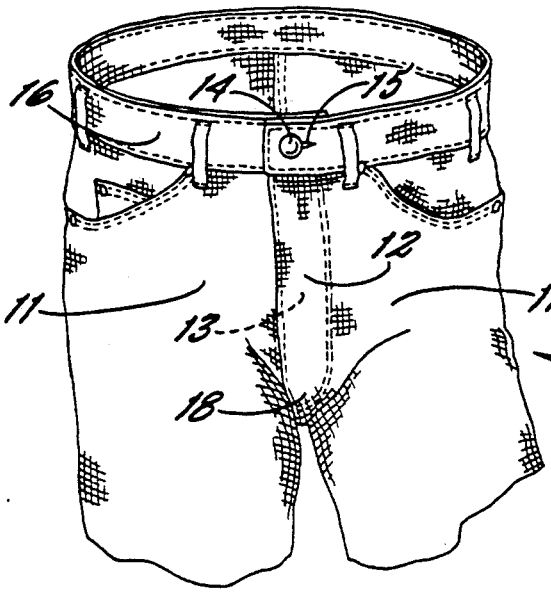
FIG. 1 is a perspective view of the front of a pair of trousers with a zipper according to the invention with the zipper in the closed position and the overlapping waistband portions buttoned together.
Figure 3:
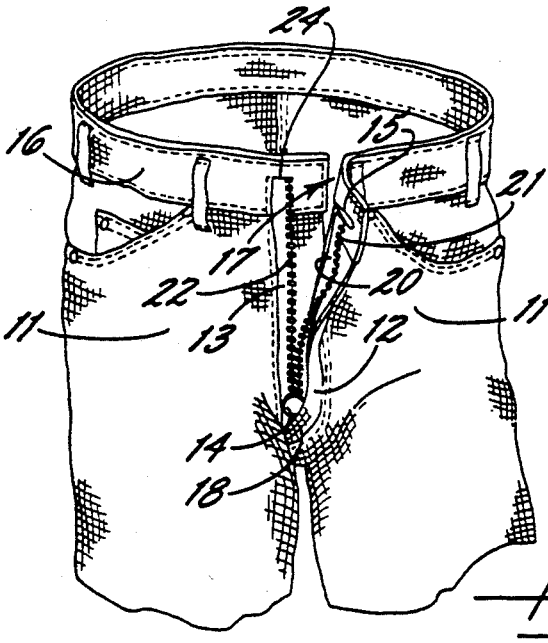
FIG. 3 is a perspective view of the front of a pair of trousers with a zipper according to the present invention with the zipper in the open position.

Turning first to FIG. 1, there is shown a perspective view of the front of a pair of trousers 10 including the zipper according to the invention. The trousers 10 include a front panel section 11 with overlapping fabric portions 12 and 13 and a button 14 and button hole 15 where the waistband 16 is closed as in the wearable position. As is typical with trousers, the two overlapping fabric portions 12 and 13 make up what is commonly referred to as the fly on a pair of trousers. These overlapping portions define an access opening 17 that, when open as shown in FIG. 3, allows a wearer to pull on and take off the trousers easily. Once the trousers are pulled up, the zipper is closed and waistband buttoned together to fit the trousers to the trunk of a person and keep them from falling down.

Figure 2:
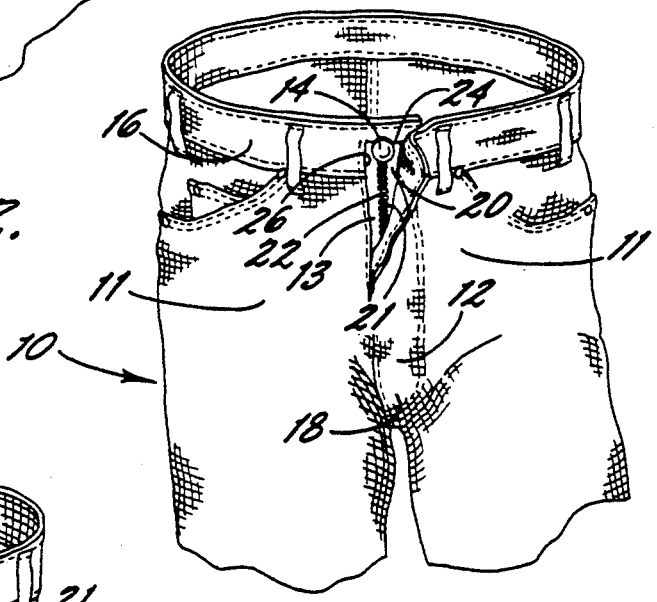
FIG. 2 is a perspective view of the front of a pair of trousers with a zipper according to the invention with the zipper closed and the waistband unbuttoned.

The access opening 17 includes two overlapping fabric portions 12 and 13 that define an opening from the crotch 18 of the trousers upward through the waistband 16. This access opening 17 defined by the overlapping portions of fabric is closed by a zipper. Conventional trousers are characterized by a zipper that extends from the crotch area to the bottom edge of the waistband. In the present invention, as shown in FIGS. 2 and 3, the zipper has an upper end 24 that extends into the waistband 16 of the trousers to approximately the middle of the waistband.

Each of the overlapping fabric portions has a fabric zipper tape 20 sewn or otherwise adhered to it. The zipper tape carries opposing pairs of cooperating teeth 21 connected to the proximal edges 22 of the zipper tape. The zipper also includes a slide 23 for moving the teeth into closed and open zipper positions thereby closing or opening the access opening 17. In a preferred embodiment, a button 14 is secured to the upper or outwardly facing side 25 of the zipper slide 23 so that when the zipper is in its closed position, and the slide is at the upper end 24 of the zipper, the button is positioned opposite a button hole 15 in the overlapping portion 12 of the waistband. Therefore, when the zipper is in the closed position, the overlapping waistband portion 12 is readily buttoned to the button 14 on the zipper slide 23 to both secure the overlapping waistband portions together and to lock the zipper into the closed position. In other words, the button on the zipper slide cooperates with the button hole to secure the overlapping fabric portion together.

In addition to securing the overlapping fabric portions and waistband portions, the button 14 on the zipper slide 23 provides an easy handle to facilitate the grasping and movement of the zipper slide up and down. The button on the slide is more desirable than a conventional flat tab on a conventional zipper slide that is sometimes difficult to grasp.

As illustrated, the zipper tape 20 sewn to the innermost overlapping fabric portion 13 is sewn into a slit 26 in the waistband to better secure the zipper tape to the waistband and for the aesthetic enhancement of keeping the zipper tape partially obscured beneath the overlapping fabric portion. The tape still extends to the middle of the waistband so that when the slide is in the closed position, the button that is secured to the slide is opposite the button hole.

As best seen in FIG. 3, the zipper tape on the outside overlapping fabric portion terminates at the edge of the button hole to allow the button on the slide to be in a position to cooperate with the button hole of the outermost overlapping portion when in the closed position. As would be readily understood by those skilled in the art, there are alternative ways to sew or otherwise adhere the zipper tape to the overlapping fabric portions so that the upper end of the zipper terminates in the mid point of the waistband.

Figure 4:
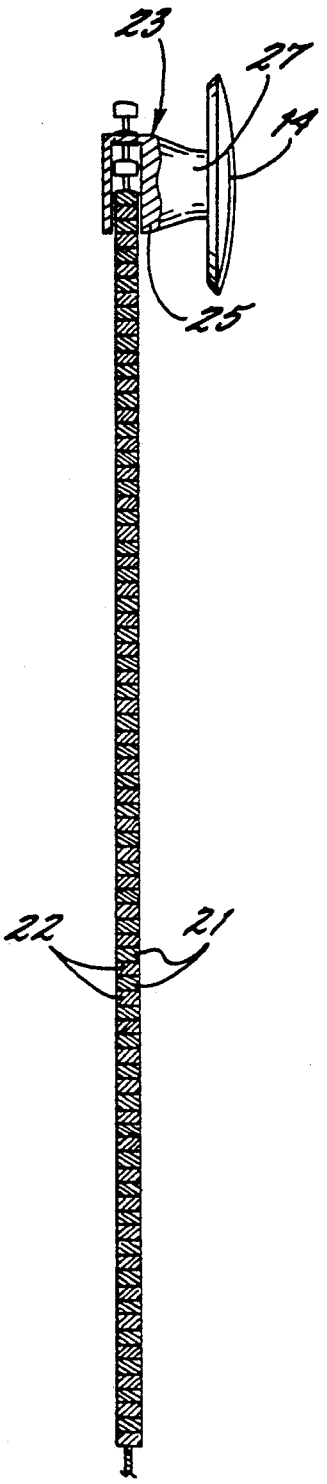
FIG. 4 is a side fragmentary view of a zipper according to the invention in the closed position.
Figure 5:
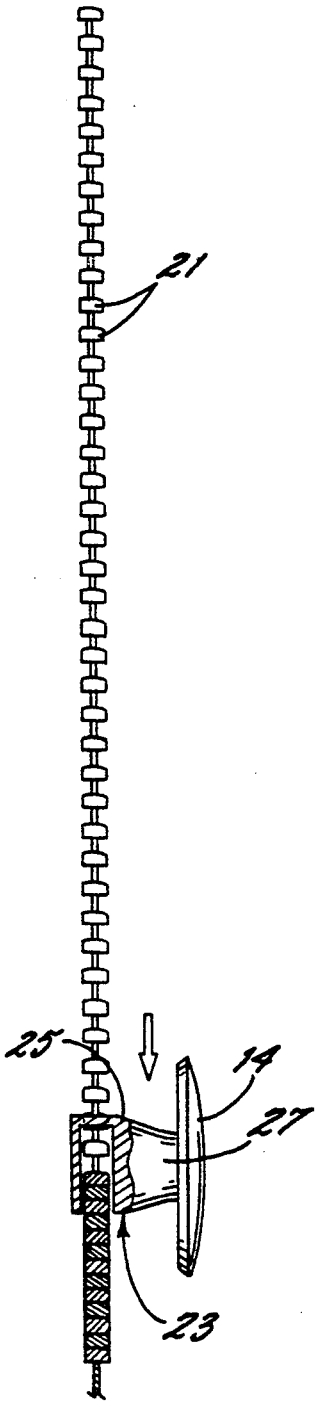
FIG. 5 is a side view of a zipper according to the invention in the open position.

As seen best in FIGS. 4 and 5, the button 14 secured to the slide is preferably fixedly secured to an upper surface 25 of the slide 23 and projects outwardly therefrom to be in a position to cooperate with the button hole 15 of the outer flap of the overlapping waistband. Additionally, it is preferred that the button itself has a reduced shank portion 27 that allows better gripping and manipulating of the slide 23 and further provides a better cooperating relationship with the button hole 15. The fixed securement of the button, as well as the reduced shank portion are preferred particularly for jeans or other denim products where the fabric portions are of substantially heavy fabric.

Many modifications and other embodiments of the subject invention will readily come to one skilled in the art having the benefit of the teachings presented in the foregoing descriptions in accompaniment with the associated drawings. Therefore, it is to be understood that the invention is not to be limited thereto and that the modifications and embodiments are intended to be included within the scope of the appended claims.

That which is claimed is:

1. A pair of trousers, having a waistband extending around and encircling upper portions of the trousers and a pair of overlapping fabric portions attached thereto and defining an access opening for facilitating the placing on and removal of the pants from a wearer, the combination therewith of a zipper attached to said overlapping fabric portions and having opposing pairs of cooperating teeth and a slide for moving said pairs of teeth into closed and open zipper positions, said zipper having an upper end extending into said waistband with said teeth being exposed and terminating about midway of a width of the encircling waistband, said zipper having a button secured to said slide for facilitating the manual grasping of the slide and the movement thereof to the desired open or closed zipper position, and a buttonhole provided in said waistband of an outermost overlapping fabric portion adjacent an end thereof and cooperating with said button on said zipper slide to receive the button and secure the zipper when in the closed position so as to prevent accidental opening of the zipper.

2. A pair of trousers according to claim 1 wherein said zipper has a pair of opposing fabric tapes and wherein said pairs of cooperating teeth are connected to and carried by proximal edges of said pair of tapes, and wherein said waistband has a slit portion in an innermost overlapping fabric portion and through and from which one of the tapes of said pair of tapes extends to position the teeth carried by an upper end of the tape in exposed accessible portion for cooperation with said slide.

3. A pair of trousers according to claim 1 wherein said button secured to said slide has a reduced shank portion for facilitating manipulating and position of the button into cooperating relationship with said buttonhole.

4. A pair of trousers according to claim 1 wherein said slide has upper and lower surfaces and said button is fixedly secured to said upper surface of said slide and projects outwardly therefrom.

5. A pair of trousers, having a waistband extending around and encircling upper portions of the trousers and a pair of overlapping fabric portions attached thereto and defining an access opening for facilitating the placing on and removal of the pants from a wearer, the combination therewith of a zipper attached to said overlapping fabric portions and having opposing pairs of cooperating teeth and a slide for moving said pairs of teeth into closed and open zipper positions, said zipper having an upper end extending into said waistband with said teeth being exposed and terminating about midway of a width of the encircling waistband, said zipper having a button secured to said slide for facilitating the manual grasping of the slide and the movement thereof to the desired open or closed zipper position, said slide having upper and lower surfaces and said button being fixedly secured to said upper surface of said slide and projecting outwardly therefrom, and a buttonhole provided in said waistband of an outermost overlapping fabric portion adjacent an end thereof and cooperating with said button on said zipper slide to receive the button and secure the zipper when in the closed position so as to prevent accidental opening of the zipper, said button secured to said slide having a reduced shank portion for facilitating manipulating and positioning of the button into cooperating relationship with said buttonhole.

6. A pair of trousers according to claim 5 wherein said zipper has a pair of opposing fabric tapes and wherein said pairs of cooperating teeth are connected to and carried by proximal edges of said pair of tapes, and wherein said waistband has a slit portion in an innermost overlapping fabric portion and through and from which one of the tapes of said pair of tapes extends to position the teeth carried by an upper end of the tape in exposed accessible position for cooperation with said slide.

* * * * *